US008191500B2

(12) United States Patent
Döhring et al.

(10) Patent No.: US 8,191,500 B2
(45) Date of Patent: Jun. 5, 2012

(54) COATING DEVICE COMPRISING FLOWING COATING MATERIAL FOR SMOOTH OR STRUCTURED SURFACES

(75) Inventors: Dieter Döhring, Lampertswalde (DE); Udo Hanitzsch, Bielefeld (DE); Gary Blenkhorn, Cape Elisabeth, ME (US)

(73) Assignees: Kronoplus Technical AG, Niederteufen (CH); Theodor Hymmen Holding GmbH, Bielefeld (DE); S.D. Warren Company, Boston, MA (US)

( * ) Notice: Subject to any disclaimer, the term of this patent is extended or adjusted under 35 U.S.C. 154(b) by 712 days.

(21) Appl. No.: 12/094,214

(22) PCT Filed: Nov. 24, 2005

(86) PCT No.: PCT/EP2005/056191

§ 371 (c)(1),
(2), (4) Date: Mar. 25, 2009

(87) PCT Pub. No.: WO2007/059805

PCT Pub. Date: May 31, 2007

(65) Prior Publication Data

US 2010/0258051 A1 Oct. 14, 2010

(51) Int. Cl.
*B05C 1/06* (2006.01)
*B05C 1/08* (2006.01)
*B05B 5/00* (2006.01)

(52) U.S. Cl. ..... 118/262; 118/642; 118/261; 118/420; 118/249

(58) Field of Classification Search ..... 118/325, 118/307, 419, 420, 308, 62, 63, 641–643, 118/410, 413, 224, 227, 249, 256, 261, 262; 427/356, 359; 156/196
See application file for complete search history.

(56) References Cited

U.S. PATENT DOCUMENTS

| | | | | |
|---|---|---|---|---|
| 4,239,821 | A * | 12/1980 | McLean et al. | 427/358 |
| 4,474,920 | A | 10/1984 | Kyminas et al. | |
| 4,537,810 | A | 8/1985 | Held | |
| 4,789,604 | A | 12/1988 | van der Hoeven | |
| 6,190,476 | B1 | 2/2001 | Seecharan et al. | |

(Continued)

FOREIGN PATENT DOCUMENTS

DE 26 19 313 11/1977

(Continued)

OTHER PUBLICATIONS

Extended European Search Report for Application No. 11000147.6 dated Feb. 17, 2011.

*Primary Examiner* — Yewebdar Tadesse
(74) *Attorney, Agent, or Firm* — Renner, Otto, Boisselle & Sklar, LLP

(57) ABSTRACT

The invention relates to a device for coating plates (6) in circulation. Said device comprises a transport system for transporting plates (6) and a feeding device (5) which can apply the coating material (8) to the surface of the plates. Means (7) for drying and/or hardening the coating material are provided next to the feeding device and above the plates. Contrary to state of the art devices, said inventive device comprises means which enable a material web (3) to pass between the transport elements for the transport of plates and means (7) for drying and/or hardening.

7 Claims, 2 Drawing Sheets

U.S. PATENT DOCUMENTS

| | | | | |
|---|---|---|---|---|
| 6,406,585 | B1 | 6/2002 | Taubert | |
| 6,423,167 | B1 | 7/2002 | Palmer et al. | |
| 7,070,406 | B2 | 7/2006 | Jeans | |
| 2004/0211361 | A1 * | 10/2004 | Suzuki et al. | 118/244 |
| 2007/0160816 | A1 | 7/2007 | Linnemann | |

FOREIGN PATENT DOCUMENTS

| | | | |
|---|---|---|---|
| DE | 42 19 446 | A1 | 12/1993 |
| DE | 199 33 100 | | 1/2001 |
| DE | 20 2004 018710 | | 3/2005 |
| DE | 103 58 190 | | 7/2005 |
| EP | 0 216 269 | A2 | 9/1986 |
| EP | 0 326 919 | | 8/1989 |
| WO | 80/01472 | | 7/1980 |
| WO | 99/61168 | | 12/1999 |
| WO | 2005/018833 | | 3/2005 |
| WO | 2005/116361 | | 12/2005 |
| WO | 2007/059967 | | 5/2007 |

* cited by examiner

COATING DEVICE COMPRISING FLOWING COATING MATERIAL FOR SMOOTH OR STRUCTURED SURFACES

FIELD OF THE INVENTION

The invention relates to an apparatus for the continuous coating of boards.

BACKGROUND

From document DE 20 2004 018 710 U1 an apparatus for the continuous coating of boards is known. Multiple boards are arranged onto a conveyor belt, which are moved individually and sequentially among others to coating stations. Such a coating station comprises an applicator roll, with which a paint is applied onto a board. Following this, a finishing apparatus is arranged, by means of which the paint is e.g. cured by means of UV radiation. The applicator roll may comprise a structured surface to apply paint in a structured manner onto the surface of the board.

From document DE 20 2004 018 710 U1, it is also known to apply paint by means of a jet printing technique, which is in particular known from inkjet printers, structured onto a surface of a board. This is again followed by a finishing apparatus, with which the coating can be cured.

An optical pattern is registered by means of an optical scanning device. The acquired information is used to synchronize a special structure of the lacquer or coating with the optical pattern.

Also known from document DE 20 2004 018 710 U1 is a coating of workpieces as e.g. plates, which are provided with an adhesion promoting layer, and a primer layer. Arranged thereon is a printing layer, which constitutes a décor. Above the décor, a layer of paint is arranged. A so-called filled paint may be used therefore. Such filled paints are paints comprising extremely fine solid particles as e.g. corundum, having a cross-section in the range of nanometers.

From document DE 103 58 190 A1, a method for the control of printing machines is known. With the apparatus known from this document, boards for furniture are printed.

It is the aim of the invention to provide an apparatus for the coating of boards.

This aim is solved by an apparatus according to claim 1. Preferred embodiments are described in the subclaims.

DETAILED DESCRIPTION OF THE INVENTION

Figure 1:
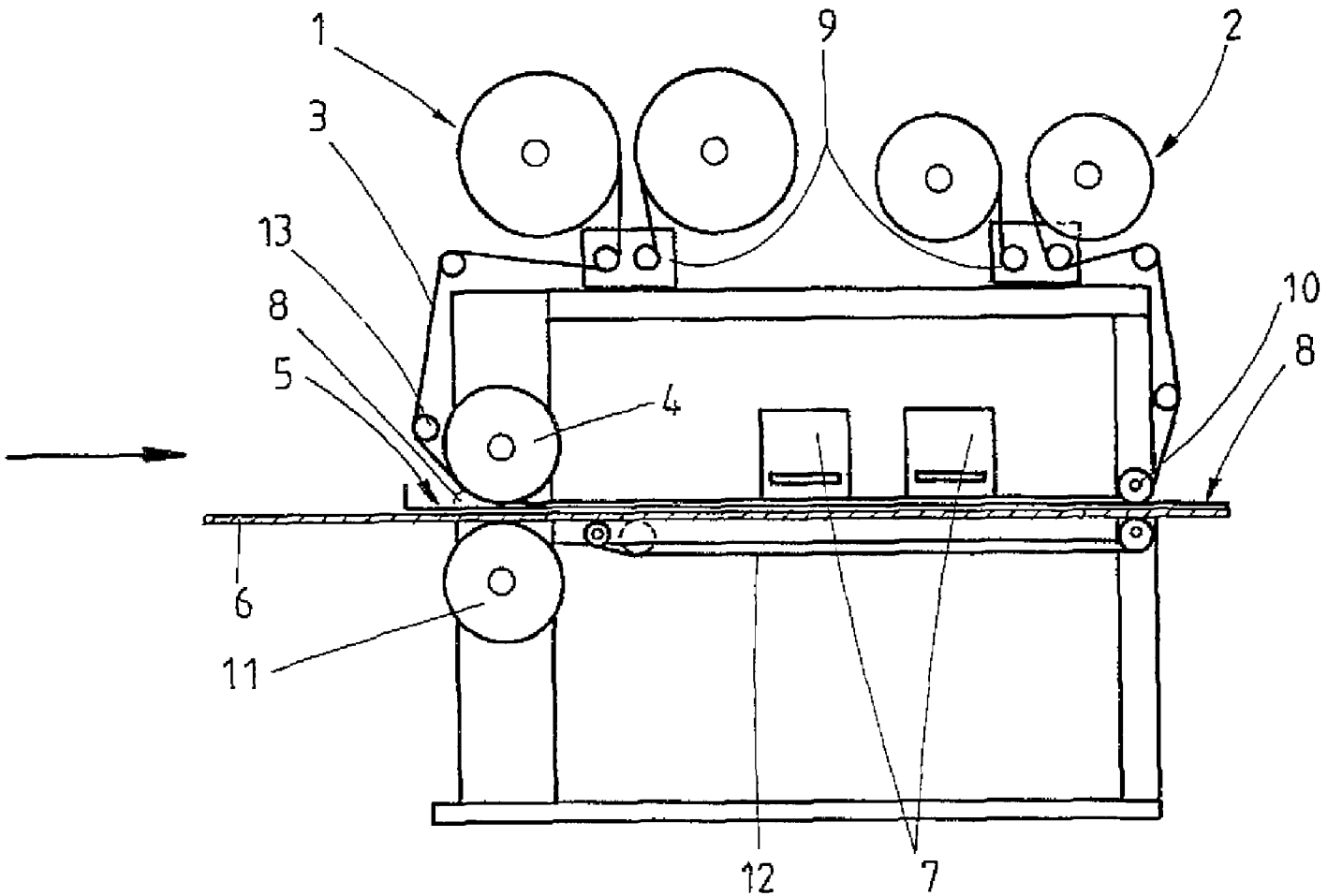
FIG. 1 is a side view of the apparatus.

To solve the object of the invention, the apparatus comprises transport means for the transport of boards. The apparatus comprises a supply arrangement, with which coating material may be applied onto the surface of the boards. Following the supply arrangement, means for drying and/or curing of the coating materials are provided above the board. In contrast to the above-mentioned prior art document DE 20 2004 018 710 U1, the apparatus according to the invention comprises means to lead a web between the transport means for the transport of boards and the means for drying and/or curing.

If a web with a structured surface is applied, the surface of the coating materials may be provided with a structure without the necessity to apply any significant pressure. Since the coating material is dried in this condition and/or cured, the coating of a board with a structured surface is achieved, without the need for usage of a press as it is known from the prior art disclosed in document DE 20 2004 018 710 U1, or alternatively a complex printing device. Additionally, a coating applied in multiple steps may uniformly be dried and/or hardened in a single production step. It is in particular possible to provide a chemical network, which extends through the whole structure of the layer, which leads to a particularly stable coating.

If a web with a smooth surface is used, a drying and/or curing under exclusion of air is possible. A drying and/or curing under exclusion of air is often desirable, e.g. to achieve a particularly large amount of interlacing that means a particularly large amount of double bondings in the paint, in the case of a curing of the paint by means of UV light. In the case of a curing by means of electron beams, an exclusion of air is usually required.

In one embodiment of the invention, the supply arrangement comprises a collecting arrangement for the coating material arranged adjacent to the transport means for the transport of the boards. The collecting arrangement is further adjacent a roller for the transport of the web. The collecting arrangement is built such that liquid coating material, which is provided in the collecting arrangement, flows to the roller. In this way, it is achieved, provided that the collecting arrangement is sufficiently filled with the material, that liquid coating material may completely cover a web with a liquid film, when a web is transported over the roller. Together with a sufficient supply of liquid coating material one can achieve that the liquid coating material completely fills the space between the surface of the board and the web positioned above the board. The introduction of air into this area is thus particularly reliably prevented. A curing can thus particularly reliably be carried out under exclusion of air.

Additionally, with this embodiment it is possible to apply relatively thick layers of paint with a total thickness of e.g. 80-100 μm and uniformly dry and harden the same. This in turn allows to incorporate relatively thick abrasion resistant particles like e.g. corundum with a cross-section of up to 100 μm into the paint. Since the abrasion resistance increases with the diameter of the abrasion resistant particles in this way a relatively good abrasion resistance may be achieved. With increasing diameter of the abrasion resistant particles, at the same time the amount of abrasion material can be reduced. In this way, an improvement of the abrasion values as well as an improvement of the transparency of the abrasion resistant coating is achieved.

In one embodiment of the invention, the means for the transport of the boards comprise a circulating conveyor onto which the boards are arranged for transport.

In one embodiment of the invention, the web is rolled off from a roller, passed by means of further rollers parallel to the surface of the boards, which are transported and the web is then again rolled onto another roller. In contrast to the prior art mentioned above, an exchange of the web is sufficient if a surface structure is to be modified or if a structure of the web comprises damages, e.g. due to wear. By means of the application of the web additionally a uniform quality of a generated surface structure can be assured, since in contrast to a roller with a structured surface, the quality of the surface of the web is not changed by the de-winding of the web, which generates the structure. Additionally, the structure in the surface of the coating is generated essentially without pressure, such that the surface of the web does advantageously show no signs of wear for this reason.

In one embodiment of the invention, the rolls for the transport of the web are arranged such that they form a funnel or hopper in cross-section with the collecting arrangement. The supply of coating material to the surface of a board is thus effected by means of a gap. In this way, the proper supply of coating material between the web and the surface of the board to be coated is further improved.

In one embodiment, the width of the above-mentioned gap can be varied. This serves to control the amount of coating material which is supplied to the surface of the board. In one embodiment, the gap may be closed, in order to control the point of supply.

DESCRIPTION OF PREFERRED EMBODIMENTS

In the following, the invention is explained in more detail with reference to FIG. 1.

FIG. 1 shows an apparatus by means of which a carrier material 6 as e.g. a particle-, MDF- or HDF-board may be coated in a continuous way. As coating materials, preferably UV or electron beam cross-linkable flowable systems with suitable viscosity are used.

At the entrance of the coating apparatus, a carrier material 6 is supplied and coated with a flowable material 8. The coating is effected by means of a collecting arrangement 5, which is arranged adjacent to a roller 4. A web-like material, namely a radiation resistant, UV and/or electron radiation transparent foil 3 is passed over the roller 4. The foil comprises a smooth surface oriented to the coating material 8, if the coating 8 is intended to have a smooth surface. The corresponding surface of the foil 3 comprises a structure if the coating 8 is to be provided with a structured surface.

The web-like material, respectively the foil 3 is rolled off from a supply roll or supply roller 1, and finally rolled onto a roller 2. Between roller 1 and roller 4, three further rollers with smaller diameter are arranged along the route of transportation for the web-like material 3, which serve for the guiding of the web-like material. The supply roller 13 with the smaller diameter, which is arranged adjacent to roller 4, effects together with roller 4 that the web-like material forms together with the collecting arrangement 5 a funnel-shaped entrance for the coating material 8. The coating material 8 is e.g. paint, and is suitably supplied by means of this funnel shape between the carrier material 6 and the web-like material 3.

The entrance with a funnel-shaped cross-section leads to a gap. The width of the gap may be adjusted in order to control the supply of coating material.

Between the roller 4 and the roller 2, four further guiding rollers with smaller diameters are arranged, which serve for the guiding of the web-like material from roller 4 to roller 2. The first guiding roller 10—as seen from roller 4 in the trans-port direction of the web-like material—effects together with roller 4 that the web-like material is guided parallel to the surface of the carrier material 6.

Between roller 4 and roller 10 and above foil 3, devices 7 are arranged, by means of which the underlying coating material may be dried and/or cured. These devices are in particular devices for the curing by UV light or electron beams.

With the apparatus, a web-like smooth or structured material 3 is aligned during the coating process from supply roller 1 in longitudinal direction as well as a transverse direction and is applied synchronously by means of the roller 4 and the collecting arrangement 5 to the carrier material 6 onto the still liquid coating material. The aim of the aligning of the web-like material is to synchronize certain locations of carrier material 6 with certain locations of the web-like material with each other. To this end, in one embodiment of the invention, the speed of a carrier material respectively a board 6 is measured by means of measuring systems. Preferably optical measuring systems are applied to detect the speed of the carrier material. The speed of rotation of at least one of the rollers is e.g. measured by means of electronic or automatic sensor means, which roller is involved in the transport of the web-like materials. The data of the transport speed of each board 6 and the transport speed of the web-like material thus obtained are used for the controlling. Both speeds are controlled such that a board can be joined with the web-like material in a defined way for a controlled structuring of a surface.

In one embodiment of the invention, the web-like material comprises e.g. optical markings, which may be detected by optical sensors. The transport of the web-like materials and/or the transport of the boards 6 is controlled such that a board is coated in dependence of such an optical marking and the coating is structured depending on these optical markings. The carrier material with the liquid coating material and the web-like material on top of it passes subsequently through the curing station 7. In this station, the liquid coating material 8 is cross-linked and merges to a solid state. In doing so, the surface structure of the web-like material is fixed with the hardened layer during the curing process and imprinted therein.

At the exit of the coating apparatus, the web-like material is pulled off from the hardened solid coating material and rolled up again on a roller.

Figure 2:
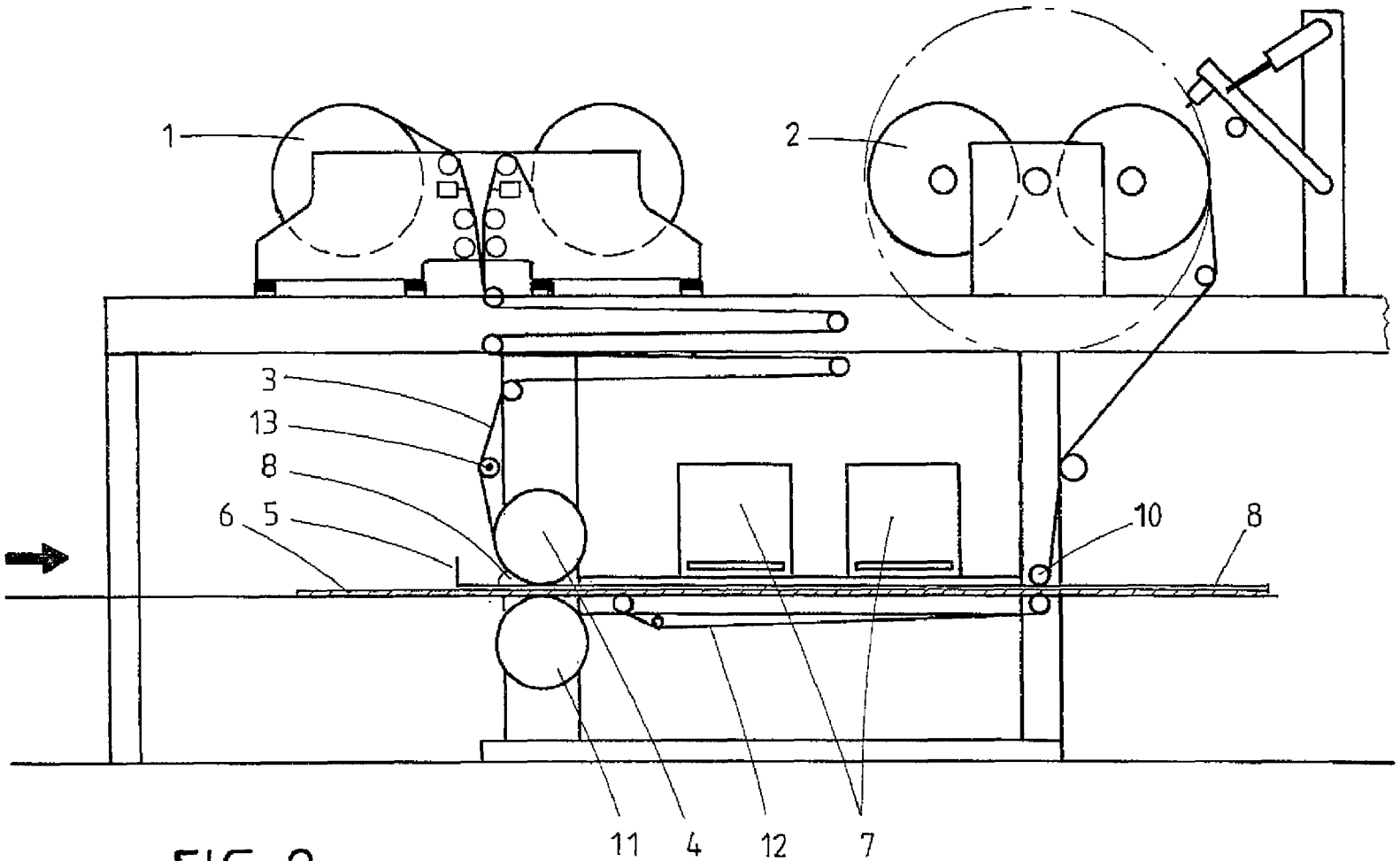
FIG. 2 is a side view of the apparatus with several rollers for the web-like material.

In the embodiment shown in FIG. 2, several supply rollers 1 and reel-up rollers 2 are provided for the web-like material. The supply rollers and the reel-up rollers can be connected during the running production by means of a suitable arrangement without any stop.

The connecting is effected preferably at speeds of not more than 120 m/min for reasons of practicality. The respective foil receiving station, which is in its idle state, is fed with a roll of the web-like material and the automatic connection is prepared by gluing a double-sided adhesive tape onto the beginning of the web. The beginning of the web-like material is introduced into a gap which serves for connecting. The web-like material, which is being reeled is guided at the same time through this gap. The effecting of the connecting is conducted automatically by means of an electronic sensing of the amount of the spent roll, from which the web-like material is being reeled or by means of the sensoric detection of the respective end of a web-like material. Prior to the connection, the dereeling web-like material is stored in a dancer roll device which works as a supply store. The driven roll is reduced to a change speed of approx. 15 m/min. The missing length of the web-like material in relation to the speed of the device is pulled out of the dancer roll. After the connecting process, the corresponding foil roll accelerates again up to the maximum speed of e.g. 120 m/min, until the dancer roll has reached again its work position.

The device for the automatic connection comprises at least two dereeling stations, having hingable supports and pneumatic tension rolls. The drive of the dereeling is effected by means of a servo motor each, and means are provided to automatically adjust carriages with the foils, respectively the web-like materials. The actual connection device comprises four pneumatically actuated mangle rolls. Further, two cutting knives are provided for the cutting of the web-like material after connection. An automatic brake force regulation is provided for the dereeling rolls. The same comprises dancer rolls, pneumatically proportional controllable linear cylinders, having guiding and diverting rollers, having an automatic break control.

The carrier material, respectively a board 6 is first passed between the two rotating rollers 4 and 11, which are arranged stacked over each other and thus transported. From this point, the carrier material 6 is passed to a transport belt which transports the carrier material even further. The web-like material respectively the foil 3 and the carrier material 6 are transported with the same speed.

The distance between the rollers 4 and 11 can be adjusted to vary the thickness of the coating. In one embodiment, also the height of the guiding roller 10 may be changed to influence the thickness of the coating.

The invention claimed is:

1. Apparatus having transport means for transporting boards, a supply arrangement for supplying coating material onto the surface of the board, means for drying and/or curing the coating material supplied to the surface of the board, means with which a web can be passed between the transport means for transporting boards and the means for the drying and or curing, and a collecting arrangement for coating material and rollers for transporting the web arranged thereon, such that the web and the collecting arrangement form the supply arrangement for supplying the coating material between the surface of the board and the web, which has a funnel-shape in cross-section.

2. Apparatus according to claim 1, in which the supply arrangement comprises the collecting arrangement for the coating material, by means of which the coating material may be passed between the surface of the board and the web.

3. Apparatus according to claim 1, wherein the web has a structured surface.

4. Apparatus according to claim 1, having one or more additional rollers for the de-reeling of the web as well as one or more additional rollers for the rolling-up of the web.

5. Apparatus according to claim 1, wherein one or more of the rollers may be raised and/or lowered, to adjust the thickness of the coating.

6. Use of an apparatus according to claim 1, for the coating of a surface, wherein sufficient coating material is supplied between the web and the surface of the board, such that no air is enclosed and such that the coating may subsequently be cured by means of UV light or electron beams.

7. Use according to claim 1, wherein the coating material comprises a paint which is curable by means of UV light or electron beams.

* * * * *